US006060794A

United States Patent [19]

Takagi et al.

[11] Patent Number: 6,060,794

[45] Date of Patent: May 9, 2000

[54] POWER WINDOW DEVICE AND A CONTROL DEVICE USED FOR THE SAME

[75] Inventors: Isao Takagi; Shuichi Nagaoka; Minoru Hiwatari, all of Miyagi-ken, Japan

[73] Assignee: Alps Electric Co., Ltd., Japan

[21] Appl. No.: 09/235,633

[22] Filed: Jan. 22, 1999

[30] Foreign Application Priority Data

| | | | |
|---|---|---|---|
| Jan. 23, 1998 | [JP] | Japan | 10-011557 |
| Mar. 31, 1998 | [JP] | Japan | 10-086327 |
| Mar. 31, 1998 | [JP] | Japan | 10-086328 |
| Mar. 31, 1998 | [JP] | Japan | 10-086329 |

[51] Int. Cl.[7] ..... H01H 35/18; H01H 47/00

[52] U.S. Cl. ..... 307/125; 307/113; 307/116; 307/118

[58] Field of Search ..... 318/280, 281, 318/282, 283, 286, 483, 452, 446, 447, 448, 449; 307/125, 10.1, 112, 116, 118

[56] References Cited

U.S. PATENT DOCUMENTS

| | | | |
|---|---|---|---|
| 4,328,451 | 5/1982 | Barge . | |
| 5,547,208 | 8/1996 | Chappell et al. | 180/281 |
| 5,925,997 | 7/1999 | Yamaoka | 318/483 |
| 5,994,797 | 11/1999 | Yamaoka | 307/125 |

FOREIGN PATENT DOCUMENTS 296 17 425 U
1 11/1996 Germany .

OTHER PUBLICATIONS

Abstract, Japanese Patent No. 07 230736 A, *Shigetoshi*, vol. 095, No. 011, Dec. 26, 1995.

Abstract, Japanese Patent No. 08 203399 A, *Shigetoshi*, vol. 096, No. 012, Dec. 26, 1996.

*Primary Examiner*—Stephen W. Jackson
*Assistant Examiner*—Rios Roberto
*Attorney, Agent, or Firm*—Brinks Hofer Gilson & Lione

[57] ABSTRACT

A power window device which uses a driving source such as a motor and the like for opening and closing a window, and a controlling device used for the same, have a submersion detecting element for detecting intrusion of water in the event that the automobile is submerged in water and a switching device (including a first switch for manually instructing the opening operation of the window, a second switch for manually instructing the closing operation of the window, a first driving unit comprised of a relay and the like for connecting the power source to the driving source such that the driving source is driven in the direction of opening the window, based on the operation of the first switch, a second driving unit comprised of a relay and the like for connecting the power source to the driving source such that the driving source is driven in the direction of closing the window, based on the operation of the second switch, and a control unit), so that the control unit can execute control for realizing opening action of the window in a sure manner by operating of the first switch even in the event that the switching device is submerged, in the event that the submersion detecting element detects intrusion of water.

26 Claims, 12 Drawing Sheets

POWER WINDOW DEVICE AND A CONTROL DEVICE USED FOR THE SAME

BACKGROUND OF THE INVENTION

1. Field of the Invention

The present invention relates to a waterproof power window device, and more particularly to a power window device and a control device used therefor which, in the event that an automobile becomes submerged in water for some reason, allows the door windows to be opened in a sure manner by operating a window opening switch.

2. Description of the Related Art

In the event that an automobile is submerged in water, power window devices generally used for automobiles are such that the window-opening switch and window-closing switch are submerged, and thus the contact points of the switches are flooded and consequently an electrically insulated state can hardly be maintained between the points, resulting in the windows initially being moved in an uninstructed and unpredictable manner since the open electrical points begin conducting via the relatively small resistance therebetween, and further, operating the window-opening switch does not open the window in a sure manner.

FIG. 13 is a circuit diagram illustrating an example of the circuit configuration of the principle components of such a known power window device.

As shown in FIG. 13, the power window device is comprised of a window-closing switch 31, a window-closing relay 32 and the contact point 32C thereof, a window-opening switch 33, a window-closing relay 34 and the contact point 34C thereof, an automatic window-opening switch 36, a window-opening/closing motor 37, a controlling integrated circuit (hereafter referred to simply as an "IC"), and an onboard power source 39.

Further, the window-closing switch 31 and the window-closing relay 32 are serially connected between the onboard power source 39 and a ground, and the window-opening switch 33 and the window-opening relay 34 are serially connected therebetween. The contact point A of the window-closing switch 31 and the window-closing relay 32 is connected to the terminals P and S of the controlling IC, and the contact point B of the window-opening switch 33 and the window-opening relay 34 is connected to the terminals Q and T of the controlling IC. The automatic window-closing switch 35 has one end connected to the contact point A and the other connected to terminal R of the controlling IC 38, and the automatic window-opening switch 36 has one end connected to the contact point B and the other connected to terminal R of the controlling IC 38. The contact point 32C of the window-closing relay 32 is arranged so that the movable point is connected to one end of the window-opening/closing motor 37, one fixed point is connected to the onboard power source 39, and the other fixed point is connected to the ground. The contact point 34C of the window-opening relay 34 is arranged so that the movable point is connected to the other end of the window-opening/closing motor 37, one fixed point is connected to the onboard power source 39, and the other fixed point is connected to the ground. The terminal U of the controlling IC 38 is connected to the onboard power source 39.

The power window device configured as described above generally operates as described next.

In the event that the driver or the like operates the window-closing switch 31, the contact point thereof closes, and the window-closing relay 32 is driven by the onboard power source 39. At this time, the contact point 32C of the window-closing relay 32 is switched over, the window-opening/closing motor 37 rotates in one direction, whereby the window moves in the direction of being closed. When operation of the window-closing switch 31 ceases, the contact point thereof opens, rotation of the window-opening/closing motor 37 stops, and the window stops. On the other hand, in the event that the window-opening switch 33 is operated, the contact point thereof closes, and the window-opening relay 34 is driven by the onboard power source 39. At this time, the contact point 34C of the window-opening relay 34 is switched over, the window-opening/closing motor 37 rotates in the other direction, whereby the window moves in the direction of being opened. When operation of the window-opening switch 33 ceases, the contact point thereof opens, rotation of the window-opening/closing motor 37 stops, and the window stops.

In the event that the driver or the like operates the automatic window-closing switch 35, the contact point thereof closes, and the window-closing switch 31 is also operated at the same time such that the contact point thereof closes as well. Due to the closing of this window-closing switch 31, the window-closing relay 32 is driven by the onboard power source 39, the window-opening/closing motor 37 rotates in one direction in the same manner as the case in which the aforementioned window-closing switch 31 is operated, whereby the window moves in the direction of being closed. Also, closing both the contact point for the window-closing switch 31 and the contact point for the automatic window-closing switch 35 supplies voltage from the contact point A to both terminals P and R of the controlling IC 38, and the voltage of the onboard power source 39 is latched and output to the terminal S of the controlling IC 38 in response to the voltage supplied, thereby supplying the voltage of the onboard power source 39 to the window-closing relay 32. Consequently, even in the event that operation of the automatic window-closing switch 35 is ceased so that the contact point thereof is opened, and at the same time operation of the window-closing switch 31 is ceased so that the contact point thereof is opened, the output voltage is latched to the terminal S, so the window-closing relay 32 continues to be driven, the window-opening/closing motor 37 continues to be driven in the one direction, and hence the window continues to be driven in the direction of closing. This driving of the window in the direction of closing continues until the window is fully closed.

In the same way, in the event that the automatic window-opening switch 36 is operated, the window-opening/closing motor 37 rotates in the other direction, whereby the window moves in the direction of being opened. Also, the voltage of the onboard power source 39 is latched and output to the terminal T of the controlling IC 38, so the window-opening relay 34 continues to be driven, the window-opening/closing motor 37 continues to be driven in the other direction, and hence the window continues to be driven in the direction of opening. This driving of the window in the direction of opening continues until the window is fully opened.

Now, in the event that the automobile is submerged in water for some reason, the arrangement of the above-described known power window device is such that when the window-closing switch 31 or the window-opening switch 33 is flooded, leakage resistance 31R and 33R of relatively small resistance are connected between the switches 31 and 33 owing to the water, and even through the points for the window-closing switch 31 and the window-opening switch 33 are open the output voltage of the onboard power source is applied to the window-closing relay 32 and the window-opening relay 34 via the leakage resistance 31R and 33R, meaning that the window-closing relay 32 and the window-opening relay 34 are driven in an unpredictable manner regardless of the intentions of the passengers. Consequently, even in the event that the driver of the automobile or another person attempts to open the window by operating the window-opening switch 33 to drive the window-opening relay, if the window-closing relay is being driven by the leakage resistance 31R, the window opening/closing motor 37 is not driven, and the window will not open. To summarize, known power window devices are problematic in that in the event the automobile is submerged and the power window device is flooded, normal window operating cannot be carried out any more.

SUMMARY OF THE INVENTION

The present invention has been made to thoroughly solve all of the above problems, and accordingly, it is an object of the present invention to provide a power window device and a control device used therefor wherein flooding of a waterproof power window device is speedily detected, and a state for dealing with the flooding is immediately brought about.

In order to achieve the above object, a submersion detecting element is provided to the power window device according to the present invention, and the control device used for the same.

According to the above means, in the event that the automobile is submerged, the submersion detecting element detects submersion at an early state, the control unit receives this detection of submersion and simultaneously drives the two driving units for opening/closing of the window simultaneously, thereby preventing the driving units from operating in an uninstructed and unpredictable manner due to intrusion of water to the switches, hence allowing the window to be opened in a sure manner by operating the window opening switch. Accordingly, the driver and other passengers can speedily escape from the opened windows.

According to an embodiment of the present invention, a power window device and controlling device has a control unit to which are connected at least a submersion detecting element and a switching device (including a manually operated first switch, a second switch, a first driving unit which is driven by the first switch, and a second driving unit which is driven by the second switch), so that the control unit can realize opening action of the window in a sure manner by operating of the first switch even in the event that the switching device is submerged, in the event that the submersion detecting element detects intrusion of water.

According to a first specific example of the embodiment of the present invention, the first driving unit and the second driving unit comprise relays.

According to a second specific example of the embodiment of the present invention, the control unit is a controlling integrated circuit, the first switch and the second switch are single-circuit two-contact-point switches of which one end is selectively switched between a power source and a ground, wherein the other end of the first switch is connected to one end of the first relay, the other end of the second switch is connected to one end of the second relay, the other end of the first relay is connected to the contact point of the second switch and the second relay and also to terminal No. 1 of the controlling integrated circuit, and the other end of the second relay is connected to the contact point of the first switch and the second relay and also to terminal No. 2 of the controlling integrated circuit.

A third specific example of the embodiment of the present invention further comprises a semiconductor detecting element, wherein the semiconductor detecting element is connected between the power source terminal and the detecting terminals, and the submersion detecting element is connected between the semiconductor detecting element and the ground.

According to a fourth specific example of the embodiment of the present invention, the submersion device comprises a pair of conducting pads on the wiring substrate, positioned so as to be exposed with minute spacing therebetween.

According to a fifth specific example of the embodiment of the present invention, the submersion device comprises a pair of conducting poles on the wiring substrate, positioned so as to be erected with minute spacing therebetween.

According to a sixth specific example of the embodiment of the present invention, the submersion device is formed such that the tip portions of the pair of conducing poles is bent outwards from the plane of the substrate, in a manner parallel thereto.

A seventh specific example of the embodiment of the present invention has a plurality of the submersion devices.

An eighth specific example of the embodiment of the present invention has the submersion devices positioned on opposing edges of the wiring substrate.

A ninth specific example of the embodiment of the present invention further comprises an over-current preventing resistor 300, the over-current preventing resistor being connected between the semiconductor detecting element and the controlling terminal.

According to the embodiment of the present invention, in the event that the automobile is submerged, the submersion detecting element detects submersion at an early state, the control unit receives this detection of submersion and simultaneously drives the two driving units for opening/closing of the window simultaneously, thereby preventing the driving units from operating in an uninstructed and unpredictable manner due to intrusion of water to the switches, hence allowing the window to be opened in a sure manner by operating the window opening switch. Accordingly, the driver and other passengers can speedily escape from the opened windows.

According to the second specific example of the embodiment of the present invention, in the case that the first switch is operated, the driving of the first relay is maintained and bias power source voltage is applied to the second relay so as to disengage the second relay, so the window is opened in a sure manner.

According to the third specific example of the embodiment of the present invention, in the event that the submersion detecting element detects intrusion of water, the controlling integrated circuit can automatically be notified of the intrusion of water.

According to the fourth specific example of the embodiment of the present invention, the submersion detecting element can be easily formed using conducting patterns on the surface of the wiring substrate.

According to the fifth specific example of the embodiment of the present invention, intrusion of water can be detected at an early stage, soon after the power window device begins to flood and before there is intrusion of water to the wiring substrate.

According to the sixth specific example of the embodiment of the present invention, the submersion detecting element is formed such that the tip portions of the pair of conducing poles is bent outwards from the plane of the substrate in a manner parallel thereto, thereby improving the sensitivity of detection.

According to the seventh specific example of the embodiment of the present invention, one of the submersion detecting elements can detect intrusion of water at an earlier stage.

According to the eighth specific example of the embodiment of the present invention, intrusion of water can be detected at an early stage, regardless of the state of submersion or direction thereof.

According to the ninth specific example of the embodiment of the present invention, in the event that the submersion detecting elements are submerged, the peak value flowing through the submersion detecting elements is restricted by this resistor, thereby preventing sudden electrocorrosion of the submersion detecting elements, so that the submersion detecting capabilities of the submersion detecting elements do not rapidly deteriorate.

DESCRIPTION OF THE PREFERRED EMBODIMENTS

Embodiments of the present invention will now be described with reference to the drawings.

Figure 1:
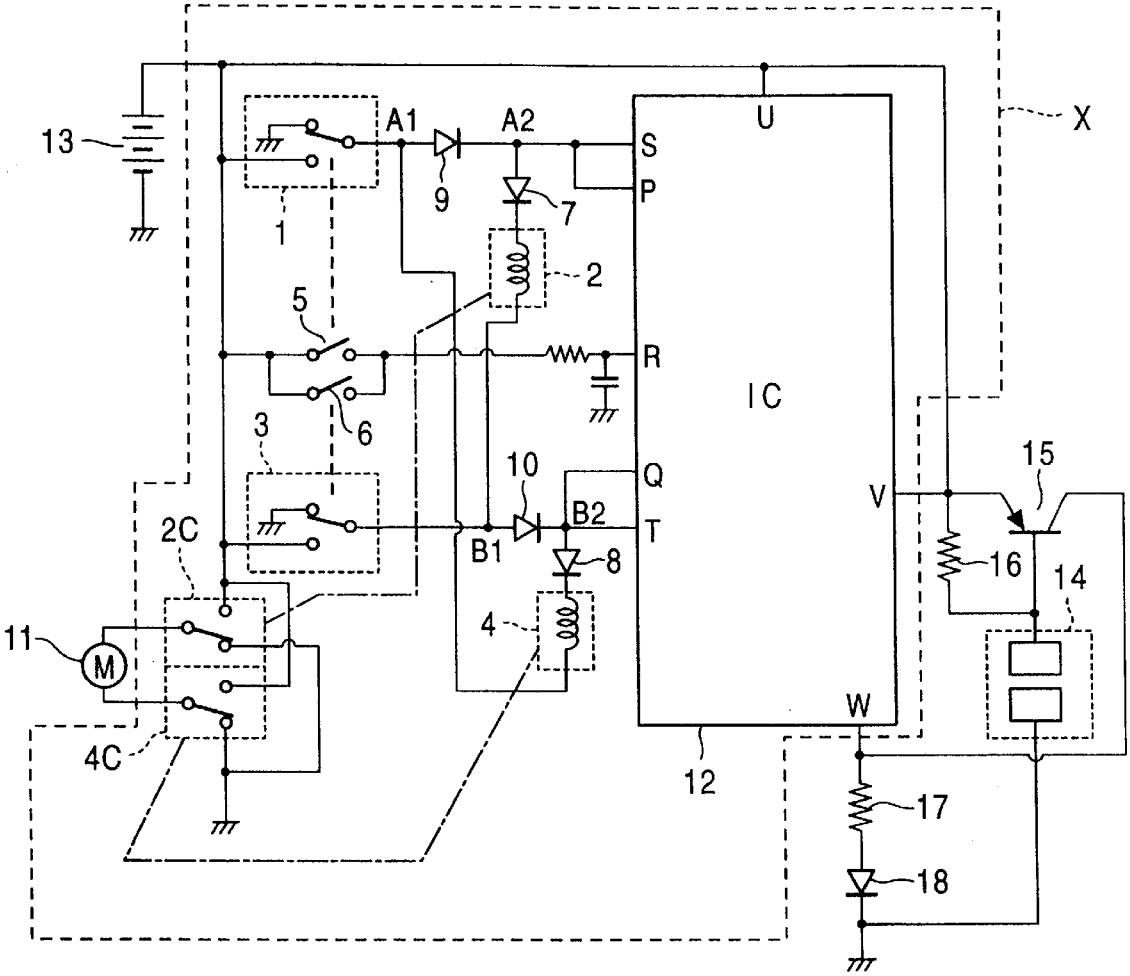
FIG. 1 is a circuit diagram illustrating the principal components of a first embodiment of a waterproof power window device according to the present invention.

FIG. 1 is a circuit diagram illustrating the principal components of a first embodiment of a waterproof power window device according to the present invention.

As shown in FIG. 1, the power window device according to the first embodiment is comprised of a control device X having a window-closing switch 1 formed of a single-circuit two-contact-point switch (first switch), a window-closing relay 2 and the contact point 2C thereof, a window-opening switch 3 formed of a single-circuit two-contact-point switch (second switch), a window-opening relay 4 and the contact point 4C thereof, an automatic window-closing switch 5, an automatic window-opening switch 6, a first reverse-flow preventing diode 7, a second reverse-flow preventing diode 8, a third reverse-flow preventing diode 9, a fourth reverse-flow preventing diode 10, a controlling integrated circuit (hereafter referred to simply as an "IC") 12. The power window device according to the first embodiment is also comprised of a window-opening/closing motor 11, an onboard power source (battery) 13, a pair of electro-conducting pads (submersion detecting element) 14, a transistor (semiconductor detecting device) 15, resistors 15 and 17, and a diode 18.

The moving contact of the window-closing switch 1, the third reverse-flow preventing diode 9, the first reverse-flow preventing diode 7, and the window-closing relay 2 are serially connected to form a first serial circuit. The moving contact of the window-opening switch 3, the fourth reverse-flow preventing diode 10, the second reverse-flow preventing diode 8, and the window-opening relay 4 are serially connected to form a second serial circuit. The window-closing switch 1 has one fixed contact point (always-closed contact point) connected to a ground, the other fixed contact point (always-open contact point) connected to the onboard power source 13, and the moving point connected to the anode of the third reverse-flow preventing diode 9. The window-closing relay 2 has one end connected to the cathode of the first reverse-flow preventing diode 7, and the other end connected to the contact point B1 between the moving contact point of the window-opening switch 3 and the anode of the fourth reverse-flow preventing diode 10. The contact point A2 between the anode of the first reverse-flow preventing diode 7 and the cathode of the third reverse-flow preventing diode 9 is connected to the terminal P (No. 1 terminal) of the controlling IC and the terminal S thereof.

The window-opening switch 3 has one fixed contact point (always-open contact point) connected to a ground, and the other fixed contact point (always-open contact point) connected to the onboard power source 13. The window-opening relay 4 has one end connected to the cathode of the second reverse-flow preventing diode 8, and the other end connected to the contact point A1 between the moving contact point of the window-closing switch 1 and the anode of the third reverse-flow preventing diode 9. The contact point B2 between the anode of the second reverse-flow preventing diode 8 and the cathode of the fourth reverse-flow preventing diode 10 is connected to the terminal Q (No. 2 terminal) of the controlling IC and the terminal T thereof.

Also, the automatic window-closing switch 5 has the moving contact point connected to the onboard power source 13, and the fixed contact point connected to the terminal R of the controlling IC 12. The automatic window-opening switch 6 has the moving contact point connected to the onboard power source 13, and the fixed contact point connected to the terminal R of the controlling IC 12. The contact point 2C of the window-closing relay 2 has the moving contact point connected to one end of the window opening/closing motor 11, one fixed contact point connected to the onboard power source 13, and the other fixed contact point connected to the ground. The contact point 4C of the window-opening relay 4 has the moving contact point connected to the other end of the window opening/closing motor 11, one fixed contact point connected to the onboard power source 13, and the other fixed contact point connected to the ground. The positive electrode side of the onboard power source 13 is connected to the terminal U and terminal V (power source terminal) of the controlling IC 12, and the negative electrode side thereof is grounded.

Further, the transistor 15 has the emitter thereof connected to the terminal V of the controlling IC 12, the collector thereof connected to the terminal W (ground terminal) of the controlling IC 12, and the base thereof connected to the ground via a pair of electro-conducting pads (i.e., the submersion detecting element). The resistor 16 is connected between the base and emitter of the transistor 15, and the resistor 17 and diode 18 are serially connected between the terminal W of the controlling IC 12 and the ground.

The power window device according to the first embodiment of the present invention as described above generally operates as follows.

First, description shall be made regarding the operation thereof under normal conditions (i.e., when there is no intrusion of water).

When the driver or another passenger operates the window-closing switch 1, the moving contact point switches from the constantly-closed side shown in the drawing to the constantly-opened side, and the voltage from the onboard power source 13 flows through the switched window-closing switch 1, the third reverse-flow preventing diode 9, the first reverse-flow preventing diode 7, the window-closing relay 2, the window-opening switch 3 which has been switched to the constantly-closed side as shown in the Figure, and finally to the ground, whereby the window-closing relay 2 is driven. At this time, at the contact point 2C of the window-closing relay 2, the moving contact point switches from the contact state shown in the Figure to the reverse contact state, voltage from the onboard power source 13 is supplied to the window opening/closing motor 11, and the window opening/closing motor 11 rotates in one direction. As a result of the window opening/closing motor 11 rotating in one direction, the window closes. When operation of the window-closing switch 1 ceases, the moving point switches to the constantly closed side as shown in the Figure, voltage from the onboard power source 13 is prevented from flowing to the window-closing relay 2 by the window-closing switch 1, and the contact point 2C of the window-closing relay 2 is in a contact state such as shown in the Figure, so the rotation of the window opening/closing motor 11 ceases, the window stops, and the window is held at that position.

On the other hand, when the driver or another passenger operates the window-opening switch 3, the moving contact point switches from the constantly-closed side shown in the drawing to the constantly-opened side, and the voltage from the onboard power source 13 flows through the switched window-opening switch 3, the fourth reverse-flow preventing diode 10, the second reverse-flow preventing diode 8, the window-opening relay 4, the window-closing switch 1 which has been switched to the constantly-closed side as shown in the Figure, and finally to the ground, whereby the window-opening relay 4 is driven. At this time, at the contact point 4C of the window-opening relay 4, the moving contact point switches from the contact state shown in the Figure to the reverse contact state, voltage from the onboard power source 13 is supplied to the window opening/closing motor 11, and the window opening/closing motor 11 rotates in the other direction. As a result of the window opening/closing motor 11 rotating in the other direction, the window opens. When operation of the window-opening switch 3 ceases, the moving point switches to the constantly closed side as shown in the Figure, voltage from the onboard power source 13 is prevented from flowing to the window-opening relay 4 by the window-opening switch 3, and the contact point 4C of the window-opening relay 4 is in a contact state such as shown in the Figure, so the rotation of the window opening/closing motor 11 ceases, the window stops, and the window is held at that position.

Also, when the driver or another passenger operates the automatic window-closing switch 5, the window-closing switch 1 is synchronously operated at the same time, the moving contact point within the automatic window-closing switch 5 closes, and the moving contact point of the window-closing switch 1 switches from the constantly-closed side shown in the Figure to the constantly-opened side. The moving contact point of the window-closing switch 1 switching to the constantly-opened side causes the voltage from the onboard power source 13 to flow through the window-closing switch 1, the third reverse-flow preventing diode 9, and the first reverse-flow preventing diode 7, and be applied to the window-closing relay 2. In the same manner as operating the window-closing switch 1 independently as described above, the window-closing relay 2 is driven, the window opening/closing motor 11 rotates in one direction, and as a result of the window opening/closing motor 11 rotating in one direction, the window closes. At this time, closing of the moving contact point of the automatic window-closing switch 5 causes voltage of the onboard power source 13 to be applied to the terminal R of the controlling IC 12, the controlling IC 12 outputs the voltage of the onboard power source 13 supplied to the terminal U to the terminal P, thereby supplying the voltage of the onboard power source 13 to the window closing relay 2. Now, in the event that the operation of the automatic window-closing switch 5 is ceased at this point, and the synchronous action of the window-closing switch 1 is also stopped thereby, the moving contact point of the window-closing switch 1 switches from the constantly-open contact point side to the constantly-closed contact point side, and the supply of the voltage of the onboard power source 13 to the window-closing relay 2 via the window-closing switch 1 is stopped, but the supply of the voltage of the onboard power source 13 output from the terminal P of the controlling IC 12 is latched and the supply of the voltage of the onboard power source 13 to the window-closing relay 2 is maintained, so the window-closing relay 2 continues to be driven. Accordingly, the rotation of the window opening/closing motor 11 in the one direction continues, and the window continues to be driven thereby. This movement of the window continues until the window reaches the uppermost portion of the movement range and the window is completely closed. In this case, the third reverse-flow preventing diode 9 is connected for applying all of the voltage of the onboard power source 13 output from the terminal P of the controlling IC 12 to the window-closing relay 2.

In the same way, when the driver or another passenger operates the automatic window-opening switch 6, the window-opening switch 3 is synchronously operated at the same time, the moving contact point within the automatic window-opening switch 6 closes, and the moving contact point of the window-opening switch 3 switches from the constantly-closed side shown in the Figure to the constantly-opened side. The moving contact point of the window-opening switch 3 switching to the constantly-opened side causes the voltage from the onboard power source 13 to flow through the window-opening switch 3, the fourth reverse-flow preventing diode 10, and the second reverse-flow preventing diode 8, and be applied to the window-opening relay 4. In the same manner as operating the window-opening switch 3 independently as described above, the window-opening relay 4 is driven, the window opening/closing motor 11 rotates in the other direction, and as a result of the window opening/closing motor 11 rotating in the other direction, the window opens. At this time, closing of the moving contact point of the automatic window-opening switch 6 causes voltage of the onboard power source 13 to be applied to the terminal R of the controlling IC 12, the controlling IC 12 outputs the voltage of the onboard power source 13 supplied to the terminal U to the terminal Q, thereby supplying the voltage of the onboard power source 13 to the window-opening relay 4. Now, in the event that the operation of the automatic window-opening switch 6 is ceased at this point, and the synchronous action of the window-opening switch 3 is also stopped thereby, the moving contact point of the window-opening switch 3 switches from the constantly-open contact point side to the constantly-closed contact point side, and the supply of the voltage of the onboard power source 13 to the window-opening relay 4 via the window-opening switch 3 is stopped, but the supply of the voltage of the onboard power source 13 output from the terminal Q of the controlling IC 12 is latched and the supply of the voltage of the onboard power source 13 to the window-opening relay 4 is maintained, so the window-opening relay 4 continues to be driven. Accordingly, the rotation of the window opening/closing motor 11 in the other direction continues, and the window continues to be driven thereby. This movement of the window continues until the window reaches the bottommost portion of the movement range and the window is completely opened. In this case, the fourth reverse-flow preventing diode 10 is connected for applying all of the voltage of the onboard power source 13 output from the terminal P of the controlling IC 12 to the window-opening relay 4.

Next, description shall be made regarding the operation in the event that there is intrusion of water into the automobile (i.e., an emergency).

In the event that the automobile is submerged in water for some reason, as soon as intrusion of water into the automobile begins, the intruding water comes into contact with the exposed pair of electro-conducting metal pads 14 at the earliest stage, so the resistance between the pair of electro-conducting metal pads 14 decreases, and the transistor 15 turns on. Then, once the transistor 15 is on, power source voltage from the onboard power source 13 is applied to the terminal W of the controlling IC 12, whereby power source voltage is applied to the terminals S and T of the controlling IC 12, so that the power source voltage is supplied to the window-closing relay 2 and window-opening relay 4. At this time, both the window-closing relay 2 and window-opening relay 4 are driven, and the contact points 2C and 4C thereof are both switched to a contact state which is opposite to the contact state shown in the Figure, but voltage from the onboard power source 13 is not applied to the window opening/closing motor 11, so the window opening/closing motor 11 does not rotate, and there is no window opening/closing action.

In this state, even in the event that a part of the power window device is short-circuited by the intruding water, the window-closing relay 2 and window-opening relay 4 are prevented from operating in an uninstructed and unpredictable manner.

Now, when the driver or another passenger operates the window-opening switch 3, the contact point of the window-opening switch 3 switches from the constantly-closed side to the constantly-opened side, and the voltage from the onboard power source 13 is applied to the window-closing relay 2, thereby stopping the driving of the window-closing relay 2, so that the contact point 2C switches to the connection state shown in the Figure. At this time, the window-opening relay 4 still remains in a driven state, and the contact point 4C is switched to a state opposite to the connection state shown in the Figure, thus voltage from the onboard power source 13 is applied to the window opening/closing motor 11, and consequently the window opening/closing motor 11 rotates in the opposite direction, whereby the window is opened, thereby allowing the driver and other passengers to escape from the opened windows of the flooded automobile.

In the event that the driver or another passenger operates the window-closing switch 1 at this time instead of the window-opening switch 3, the window can be closed by functions similar to the above-described functions.

In this way, according to the power window device according to the first embodiment, as soon as the automobile is submerged in water and the power window device begins to be flooded, the intrusion of water is detected by the pair of electro-conducting pads 14, and operating the window-closing switch 3 following this detection allows the window to be opened automatically, so this power window device according to the first embodiment has improved safety features, in addition to the functions of known power window devices.

Figure 2:
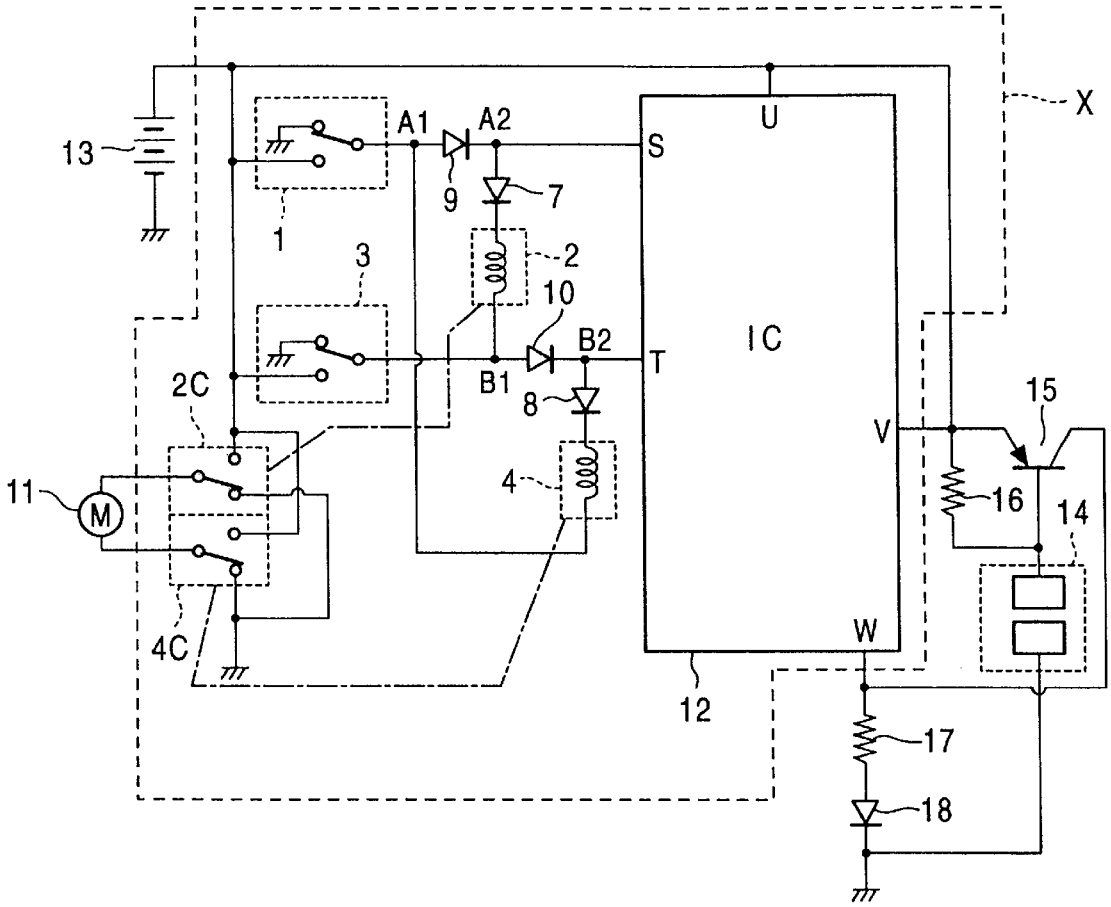
FIG. 2 is a circuit diagram illustrating the principal components of a second embodiment of a waterproof power window device according to the present invention.

Next, FIG. 2 is a circuit diagram illustrating the principal components of a second embodiment of a waterproof power window device according to the present invention.

In FIG. 2, the components which are the same as the components shown in FIG. 1 are denoted with the same reference numerals.

The second embodiment is an arrangement wherein the automatic window-closing switch 5 and the automatic window-opening switch 6 have been omitted from the first embodiment, and otherwise, the second embodiment is of the same configuration as the first embodiment. Accordingly, further description regarding the configuration of this second embodiment will be omitted.

Also, regarding the operation of the second embodiment under normal conditions (i.e., when there is no intrusion of water), the second embodiment operates in almost the same manner as the first embodiment except that automatic operation using the automatic window-closing switch 5 and the automatic window-opening switch 6 cannot be carried out. Accordingly, further description regarding the operation of this second embodiment will be omitted.

Further, regarding the operation of the second embodiment in the event that there is intrusion of water into the automobile (i.e., an emergency), the second embodiment operates in exactly the same manner as the first embodiment, and moreover, the advantages of the second embodiment are exactly the same as the advantages of the first embodiment, since both operate in exactly the same manner in an emergency. Accordingly, further description regarding the emergency operation of this second embodiment and the advantages thereof will be omitted.

Figure 3:
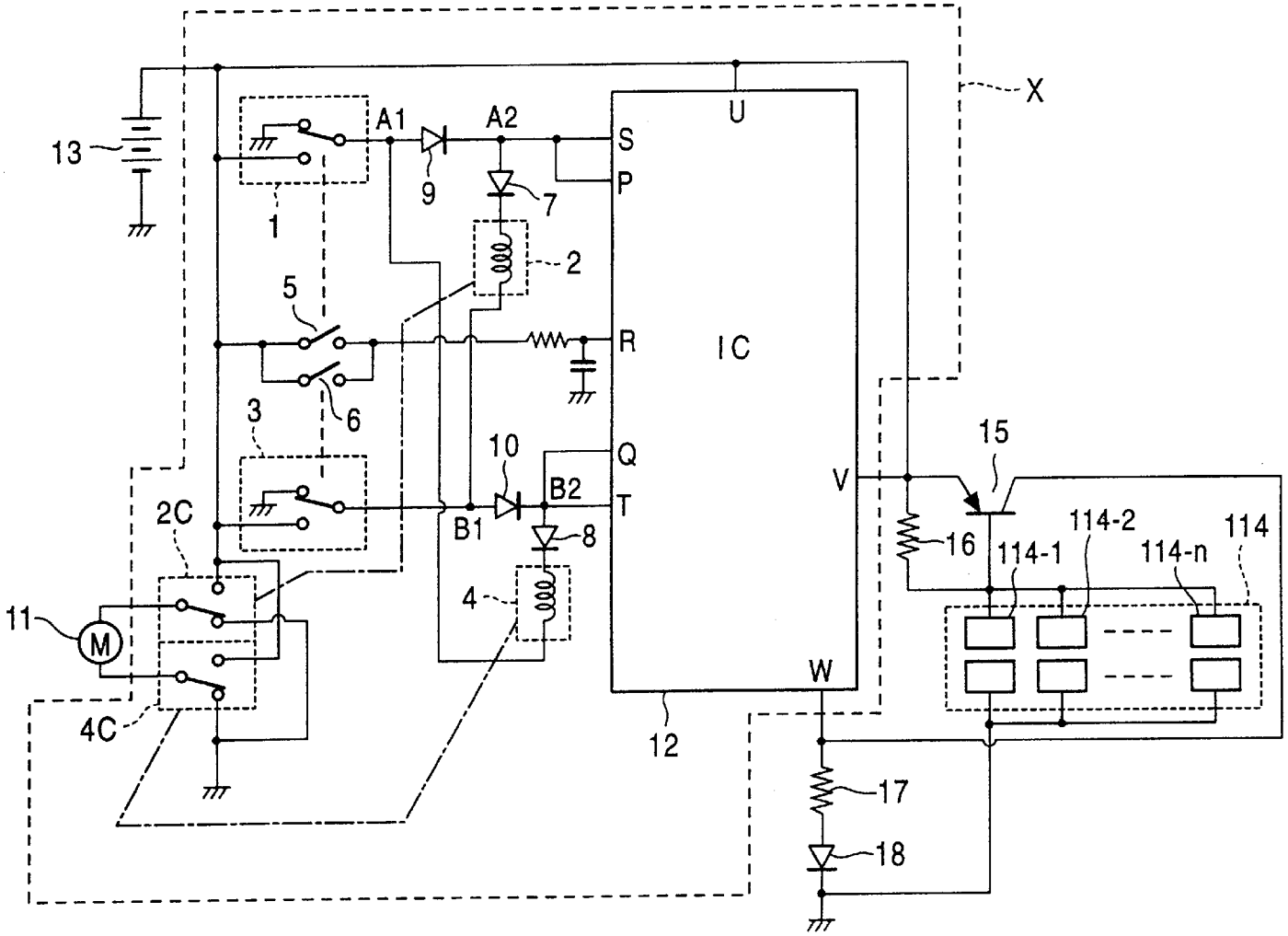
FIG. 3 is a circuit diagram illustrating the principal components of a third embodiment of a waterproof power window device according to the present invention.

Next, FIG. 3 is a circuit diagram illustrating the principal components of a third embodiment of a waterproof power window device according to the present invention. In FIG. 3, the components which are the same as the components described with reference to the first embodiment are denoted with the same reference numerals.

The power window device according to the third embodiment has a configuration similar to the configuration of the power window device according to the first embodiment, but differs in that the third embodiment has a submersion detecting electro-conductive pad group 114 formed of a plurality of pairs of pads. The overall configuration and the basic operation is the same as the first embodiment, so description regarding such will be omitted, and description regarding the submersion detecting electro-conductive pad group 114 will be made.

The submersion detecting electro-conductive pad group 114 is formed of a parallel-arrayed n-number (plurality) of pairs of pads (submersion detecting elements) 114-1, 114-2, and so forth through 114-n.

The transistor 15 has the emitter thereof connected to the terminal V of the controlling IC 12, the collector thereof connected to the terminal W (detecting terminal) of the controlling IC 12, and the base thereof connected to the ground via the pairs of electro-conducting pads 114. The resistor 16 is connected between the base and emitter of the transistor 15, and the resistor 17 and diode 18 are serially connected between the terminal W of the controlling IC 12 and the ground.

Figure 4:
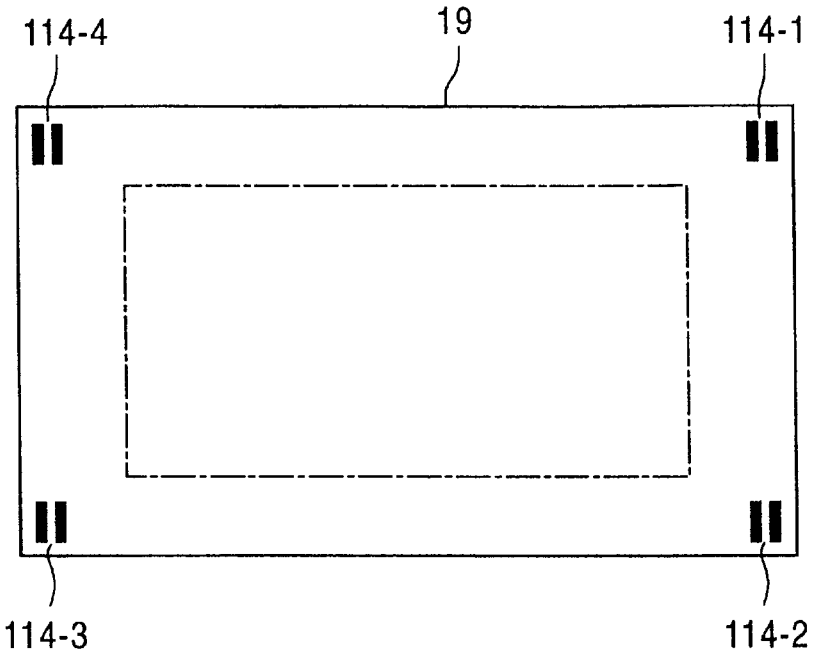
FIG. 4 is a plan view illustrating an example of the configuration of a wiring substrate having pairs of submersion detecting electro-conductive pads used with the waterproof power window device according to the third embodiment.
Figure 5:
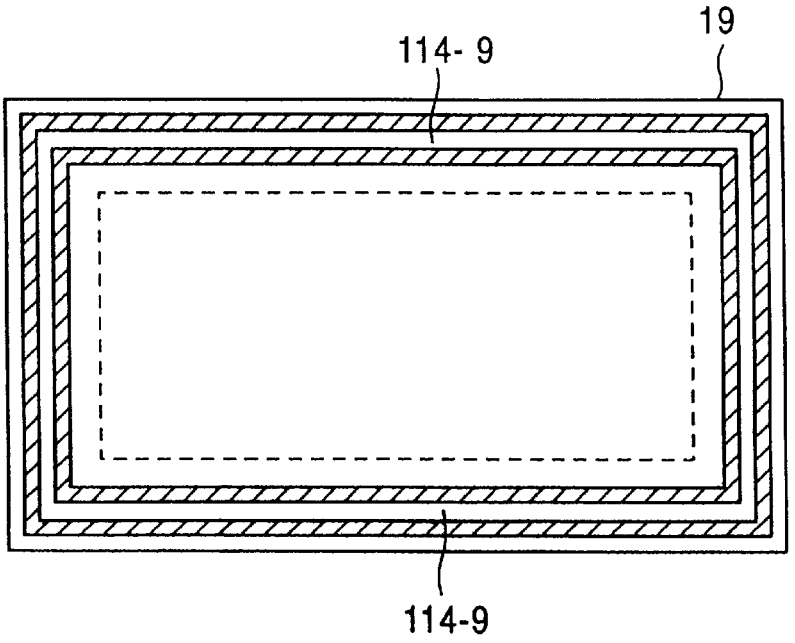
FIG. 5 is a plan view illustrating another example of the configuration of a wiring substrate having pairs of submersion detecting electro-conductive pads used with the waterproof power window device according to the third embodiment.

Also, FIG. 4 is a plan view illustrating an example of the configuration of a wiring substrate having pairs of submersion detecting electro-conductive pads 114 used with the power window device according to the third embodiment, and FIG. 5 is a plan view illustrating another example of the configuration of a wiring substrate having pairs of submersion detecting electro-conductive pads 114 used with the power window device according to the third embodiment.

In the example shown in FIG. 4, the wiring substrate 19 has an n number of submersion-detecting electro-conducting pad pairs (in this case, four, i.e., 114-1, 114-2, 114-3, and 114-4) positioned at the four corners on the perimeter thereof, and a control circuit portion (no reference number) is provided to the center portion.

Also, in the example shown in FIG. 5, the wiring substrate 19 has a band-shaped submersion-detecting electro-conducting pad pair 114-9 provided to the entire perimeter thereof, and a control circuit portion (no reference number) is provided to the center portion.

In the event that the automobile is submerged in water for some reason, when intrusion of water into the automobile begins, the power window device according to the first embodiment attached within the door is gradually flooded. As soon as intrusion of water into the automobile begins, the little amount of water which has made its way into the base portion of the waterproof power window device comes into contact with the one of the pairs of submersion-detecting electro-conducting pads 114-1 through 114-4, e.g., the submersion-detecting electro-conducting pad pair 114-1 at the earliest stage, so the resistance between the submersion-detecting electro-conducting pad pair 114-1 decreases, the base circuit of the transistor 15 is closed by the submersion-detecting electro-conducting pad pair 114-1, and the transistor 15 turns on. Or, in the event that the wiring substrate 19 having the configuration shown in FIG. 5 is used, as soon as intrusion of water into the automobile begins, the little amount of water which has made its way into the base portion of the waterproof power window device comes into contact with the pair of submersion-detecting electro-conducting pads 114-9 at the earliest stage, so the resistance between the submersion-detecting electro-conducting pad pair 114-9 decreases, the base circuit of the transistor 15 is closed by the submersion-detecting electro-conducting pad pair 114-9, and the transistor 15 turns on. Then, once the transistor 15 is on, power source voltage from the onboard power source 13 is applied to the terminal W of the controlling IC 12 via the transistor 15, whereby power source voltage is applied to the No. 1 terminal S and No. 2 terminal T of the controlling IC 12, so that the power source voltage is supplied to the window-closing relay 2 and window-opening relay 4. At this time, both the window-closing relay 2 and window-opening relay 4 are driven, and the contact points 2C and 4C thereof are both switched to a contact state which is opposite to the contact state shown in the Figure, but voltage from the onboard power source 13 is not applied to the window opening/closing motor 11, so the window opening/closing motor 11 does not rotate, and there is no window opening/closing action.

As described above, according to the waterproof power window device according to the present invention, when intrusion of water into the power window device begins, speedy submersion detection is made by one of the pairs of submersion-detecting electro-conducting pads 114-1 through 114-4 or the pair of submersion-detecting electro-conducting pads 114-9, so the transistor 15 is turned on immediately, and power source voltage is output from the No. 1 terminal P and No. 2 terminal Q of the controlling IC 12, whereby the power source voltage is supplied to the window-closing relay 2 which closes the window and the window-opening relay 4 which opens the window. Accordingly, the window can be opened or closed by operating the first switch 1 which closes the window or the second switch 3 which opens the window at an early point in flooding before the operation of the waterproof power window device becomes unstable. Particularly, the window can be opened by operating the second switch 3, thereby facilitating escape from the automobile from the opened window.

Also, countermeasures to deal with intrusion of water are realized simply by detection thereof with submersion-detecting elements, so instability is dealt with.

Figure 6:
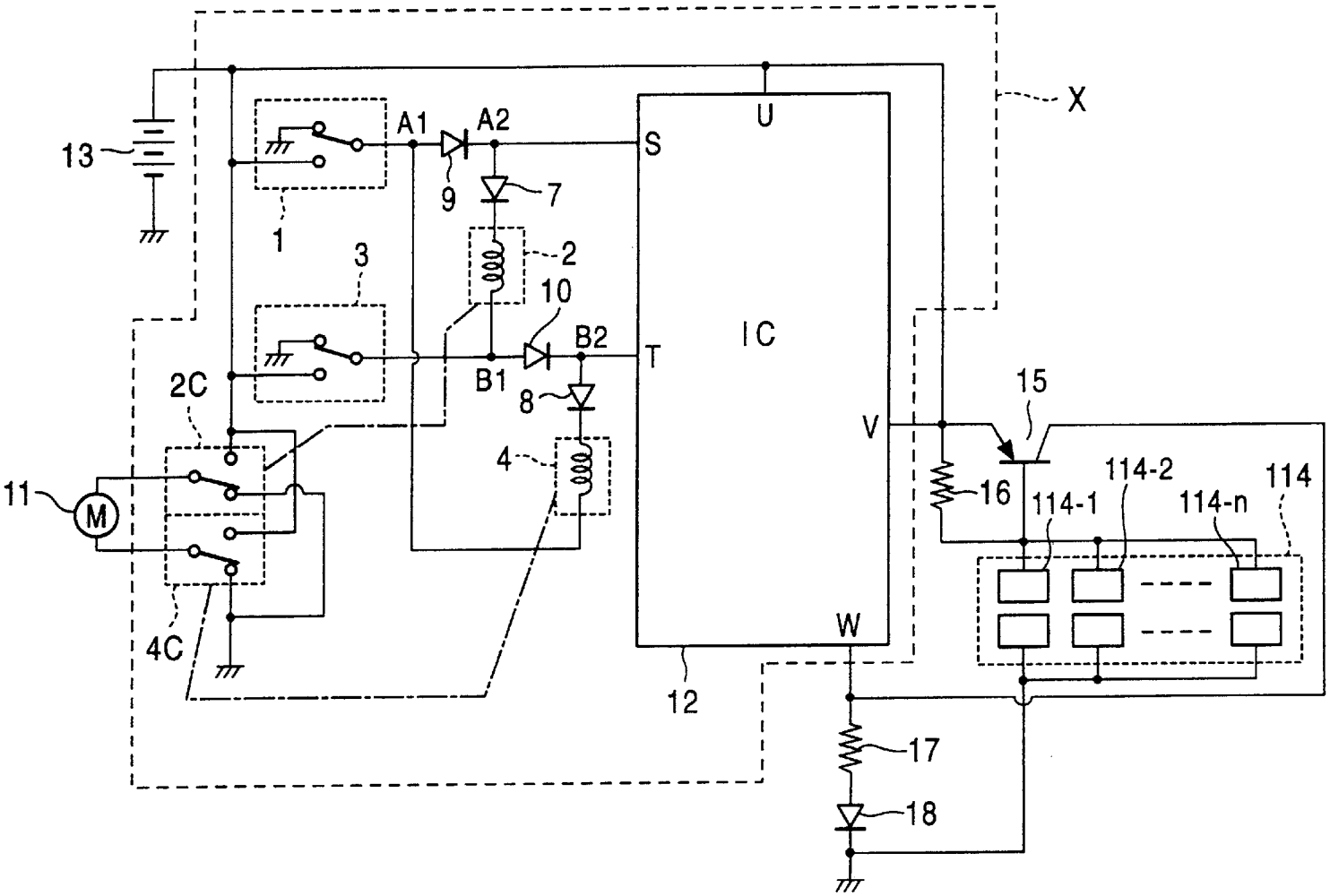
FIG. 6 is a circuit diagram illustrating the principal components of a fourth embodiment of a waterproof power window device according to the present invention.

Next, FIG. 6 is a circuit diagram illustrating the principal components of a fourth embodiment of a power window device according to the present invention.

In FIG. 6, the components which are the same as the components shown in FIG. 3 are denoted with the same reference numerals.

The fourth embodiment is an arrangement wherein the automatic window-closing switch 5 and the automatic window-opening switch 6 have been omitted from the third embodiment, and otherwise, the fourth embodiment is of the same configuration as the third embodiment. Accordingly, further description regarding the configuration of this fourth embodiment will be omitted.

Also, regarding the operation of the fourth embodiment under normal conditions (i.e., when there is no intrusion of water), the fourth embodiment operates in almost the same manner as the third embodiment except that automatic operation using the automatic window-closing switch 5 and the automatic window-opening switch 6 cannot be carried out. Accordingly, further description regarding the operation of this fourth embodiment will be omitted.

Also, with reference to the above-described embodiments, description has been made regarding an example wherein submersion-detecting electro-conducting pad pairs 14-1 through 14-4 are positioned at the four corners on the perimeter of the wiring substrate 19, but the positions for placing the submersion-detecting electro-conducting pad pairs 14-1 through 14-4 need not be at the four corners on the perimeter of the wiring substrate 19; rather, any positions which are distanced one from another and preferably diagonally opposed may be used. Further, the number of submersion-detecting electro-conducting pad pairs 14-1 through 14-4 need not be restricted to four, rather, any number will work as long as there are two or more.

Figure 7:
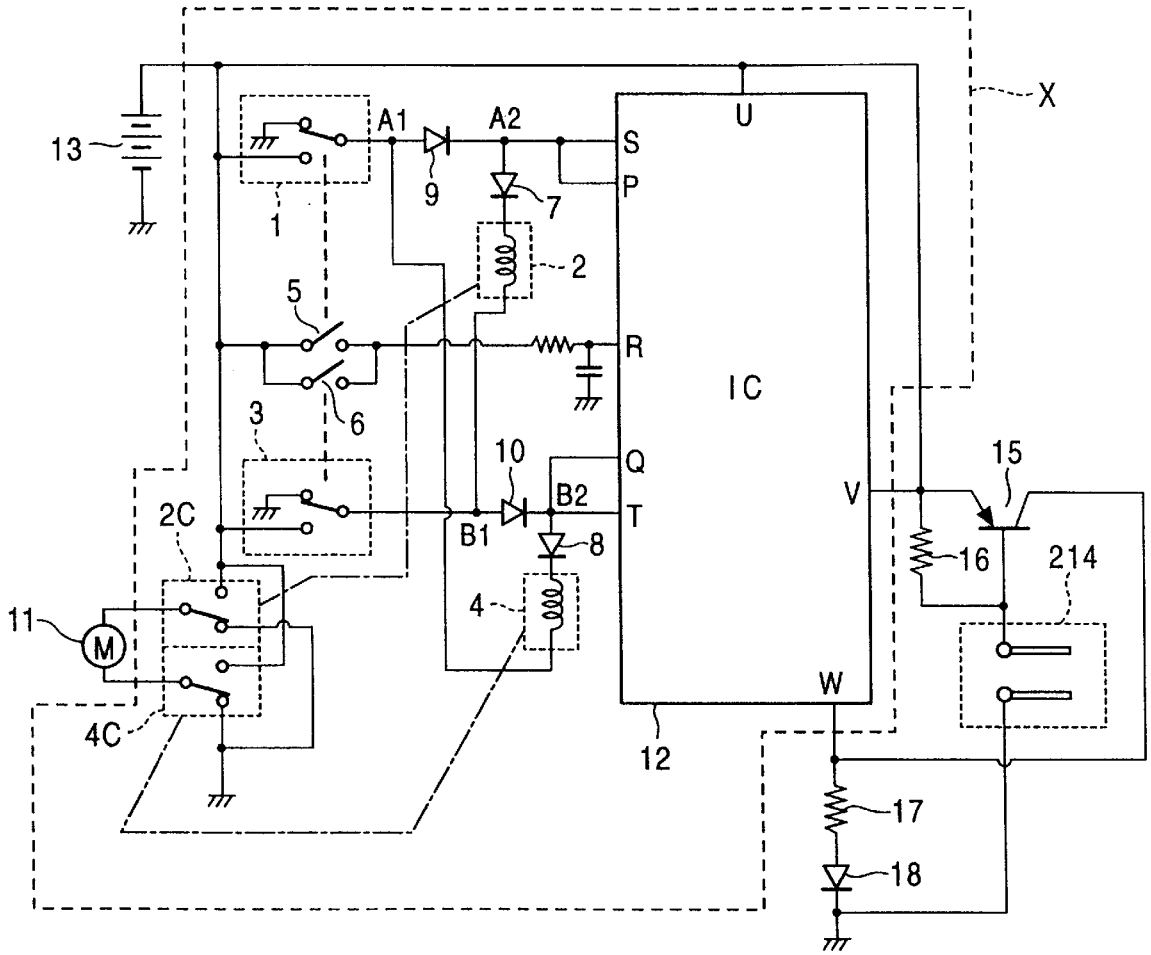
FIG. 7 is a circuit diagram illustrating the principal components of a fifth embodiment of a waterproof power window device according to the present invention.

FIG. 7 is a circuit diagram illustrating the principal components of a fifth embodiment of the power window device according to the present invention. In FIG. 7, the components which are the same as the components described with reference to the first embodiment are denoted with the same reference numerals.

The power window device according to the fifth embodiment has a configuration similar to the configuration of the power window device according to the first embodiment, but differs in that the fifth embodiment uses parallel submersion-detecting electro-conductive pins 214 instead of the electro-conductive pads used in the first embodiment. The overall configuration and the basic operation is the same as the first embodiment, so description regarding such will be omitted, and description regarding the parallel submersion-detecting electro-conductive pins 214 will be made.

In FIG. 7, The transistor 15 has the emitter thereof connected to the terminal V of the controlling IC 12, the collector thereof connected to the terminal W (detecting terminal) of the controlling IC 12, and the base thereof connected to the ground via the parallel submersion-detecting electro-conductive pins 214. The resistor 16 is connected between the base and emitter of the transistor 15, and the resistor 17 and diode 18 are serially connected between the terminal W of the controlling IC 12 and the ground.

Figure 8:
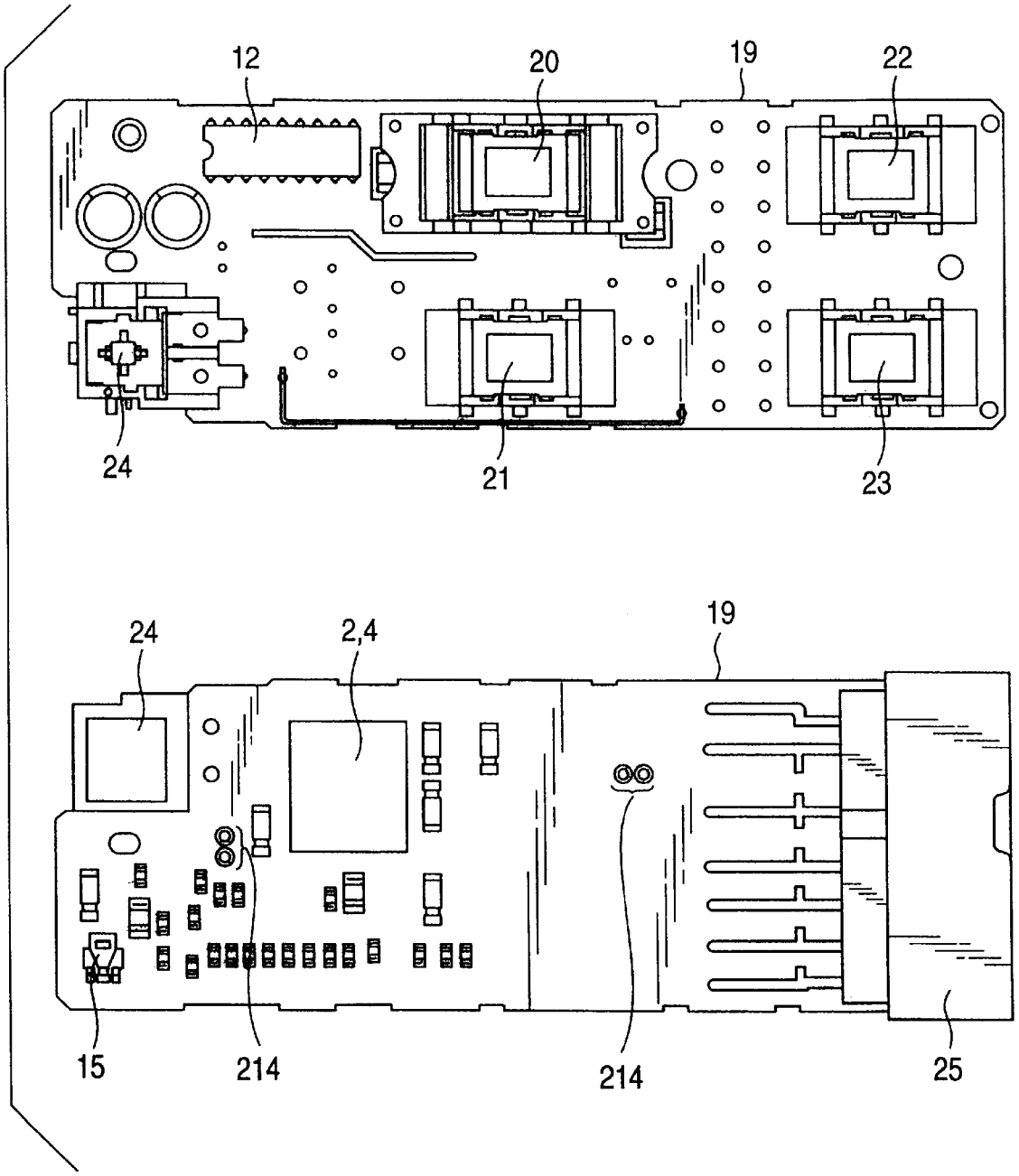
FIG. 8 shows an upper view and a lower view illustrating an example of a configuration wherein the waterproof power window device according to the fifth embodiment is provided on the wiring substrate.
Figure 9:
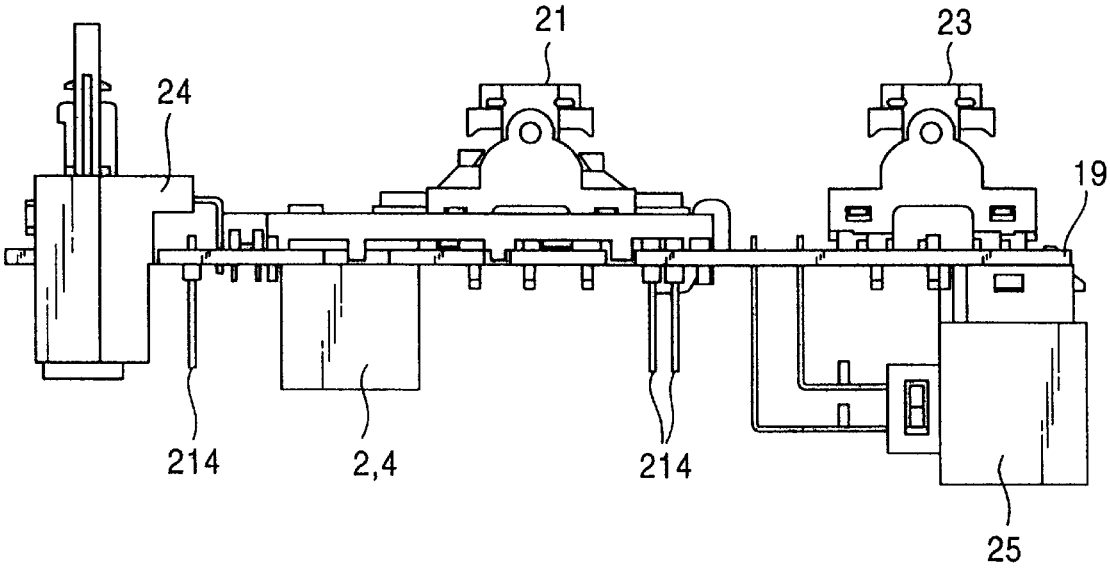
FIG. 9 is a side view illustrating an example of a configuration wherein the waterproof power window device according to the fifth embodiment is provided on the wiring substrate.

Also, FIGS. 8A, 8B, and 9 illustrate an example of a configuration wherein the power window device according to the fifth embodiment is provided on the wiring substrate, FIG. 8A being an upper view of the wiring substrate, FIG. 8B a lower view of the wiring substrate, and FIG. 9 a side view of the wiring substrate.

As shown in FIGS. 8A, 8B, and 9, the components making up the power window device are provided on the wiring substrate 19, and the components which are the same as the components shown in FIG. 7 are denoted with the same reference numerals.

The wiring substrate 19 is arranged such that the following are provided on the upper side thereof: the controlling IC 12, a driver-side window opening/closing switch 20, a front-seat passenger-side window opening/closing switch 21, a rear-seat right-side window opening/closing switch 22, a rear-seat left-side window opening/closing switch 23, etc. Provided on the lower side are the window-closing relay 2 and the window-opening relay 4, transistor 15, connector 25, etc., and a window opening/closing lock switch 24 traverses the wiring substrate 19 from the upper side to the lower side.

In this case, the pair of submersion-detecting electro-conductive pins 214 are erected to the lower side of the wiring substrate 19 so as to protrude from the wiring substrate 19 in a generally perpendicular manner. The parallel submersion-detecting electro-conductive pins 214 should preferably be at least longer than the height of the other principal portions, so as to expand the range of detection of intrusion of water.

In the event that the automobile is submerged in water for some reason, when intrusion of water into the automobile begins, the power window device according to the fifth embodiment attached within the door is gradually flooded. As soon as intrusion of water into the automobile begins, the little amount of water which has made its way into the base portion of the power window device comes into contact with the exposed pair of parallel submersion-detecting electro-conductive pins 214 at the earliest stage, so the resistance between the pair of parallel submersion-detecting electro-conductive pins 214 decreases, the base circuit of the transistor 15 is closed, and the transistor 15 turns on. Then, once the transistor 15 is on, power source voltage from the onboard power source 13 is applied to the terminal W of the controlling IC 12 via the transistor 15, whereby power source voltage is applied to the No. 1 terminal S and No. 2 terminal T of the controlling IC 12, so that the power source voltage is supplied to the window-closing relay 2 and window-opening relay 4. At this time, both the window-closing relay 2 and window-opening relay 4 are driven, and the contact points 2C and 4C thereof are both switched to a contact state which is opposite to the contact state shown in the Figure, but voltage from the onboard power source 13 is not applied to the window opening/closing motor 11, so the window opening/closing motor 11 does not rotate, and there is no window opening/closing action.

As described above, according to the power window device according to the fifth embodiment, when automobile is submerged in water and intrusion of water into the power window device begins, i.e., before the window-closing switch 3 is flooded, the little amount of water which has made its way into the base portion of the power window device comes into contact with a pair of parallel submersion-detecting electro-conductive pins 214 at the earliest stage, and speedy submersion detection is made by the parallel submersion-detecting electro-conductive pins 214. Accordingly, operating the window-opening switch 3 immediately after or following this detection allows opening of the window automatically, so this power window device has improved safety features, in addition to the functions of known power window devices.

Also, countermeasures to deal with intrusion of water are realized simply by detection thereof with parallel submersion-detecting electro-conductive pins 214, so instability is dealt with.

Incidentally, the waterproof power window device according to the fifth embodiment has two sets of parallel submersion-detecting electro-conductive pins 214 on mutually distanced positions on the wiring substrate 19, and these are wired in a parallel circuit, so the flooding countermeasures are carried out at the point that either of the sets of parallel submersion-detecting electro-conductive pins 214 detects intrusion of water, consequently enabling measures to be taken against intrusion of water at an early stage where there are no effects of the state or direction thereof.

In this case, as can be readily conceived, the greater the number of sets of parallel submersion-detecting electro-conductive pins 214 there are the better, and even better if erected in all directions.

Figure 10:
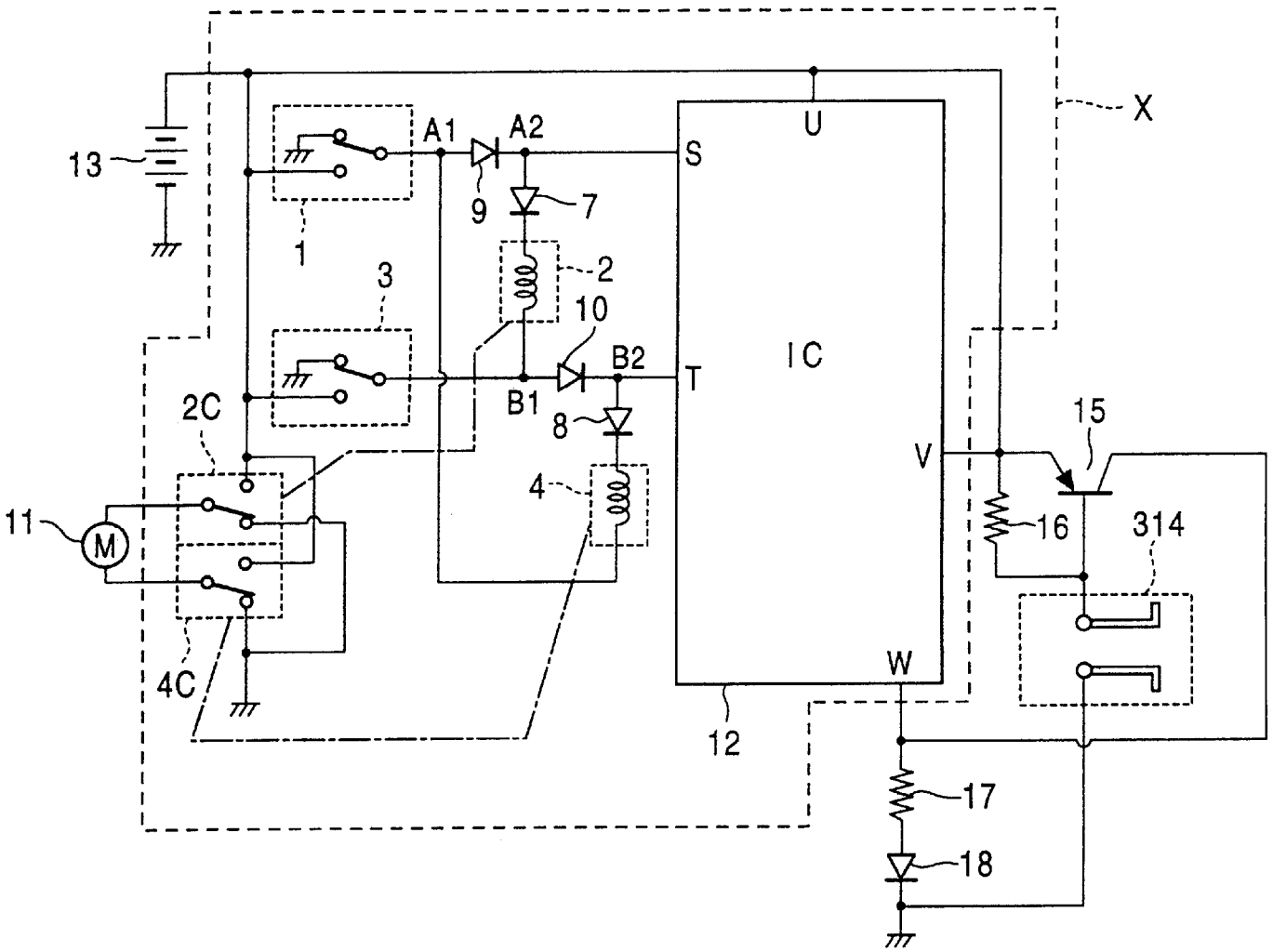
FIG. 10 is a circuit diagram illustrating the principal components of a sixth embodiment of a waterproof power window device according to the present invention.

Next, FIG. 10 is a circuit diagram illustrating the principal components of a sixth embodiment of the power window device according to the present invention.

In FIG. 10, the components which are the same as the components shown in FIG. 7 are denoted with the same reference numerals.

The sixth embodiment differs from the fifth embodiment in that the sixth embodiment is an arrangement wherein the automatic window-closing switch 5 and the automatic window-opening switch 6 have been omitted from the fifth embodiment (first point of difference), and the sixth embodiment has a pair of parallel submersion-detecting electro-conductive pins 314 with the tips thereof bent outwards in a manner opposing one another and parallel with the plane of the wiring substrate 19, instead of the straight pair of parallel submersion-detecting electro-conductive pins 214 used with the fifth embodiment (second point of difference). Otherwise, the sixth embodiment is of the same configuration as the fifth embodiment. Accordingly, further description regarding the configuration of this sixth embodiment will be omitted.

Also, regarding the operation of the sixth embodiment, the sixth embodiment operates in almost the same manner as the fifth embodiment except that automatic operation using the automatic window-closing switch 5 and the automatic window-opening switch 6 cannot be carried out, since the automatic window-closing switch 5 and the automatic window-opening switch 6 have been omitted. Accordingly, further description regarding the operation of this sixth embodiment will be omitted.

Also, regarding the advantages of the sixth embodiment, the tips of the pair of parallel submersion-detecting electro-conductive pins 314 are bent outwards, so, in comparison with the straight pair of parallel submersion-detecting electro-conductive pins 214 used with the fifth embodiment, the tips come into contact with a greater area of water from the instant of first contact, so the resistance between the parallel submersion-detecting electro-conductive pins decreases rapidly. In other words, the sensitivity of detection becomes even more sensitive.

Also, while the above description has been made with reference to examples wherein the fifth embodiment has a straight pair of parallel submersion-detecting electro-conductive pins and the sixth embodiment has a pair of parallel submersion-detecting electro-conductive pins with the tips bent outwards, but an arrangement may be used wherein the fifth embodiment has a pair of parallel submersion-detecting electro-conductive pins with the tips bent outwards and the sixth embodiment has a straight pair of parallel submersion-detecting electro-conductive pins, or wherein both the fifth and sixth embodiments have straight pair of parallel submersion-detecting electro-conductive pins, or wherein both the fifth and sixth embodiments have parallel submersion-detecting electro-conductive pins with the tips bent outwards.

Figure 11:
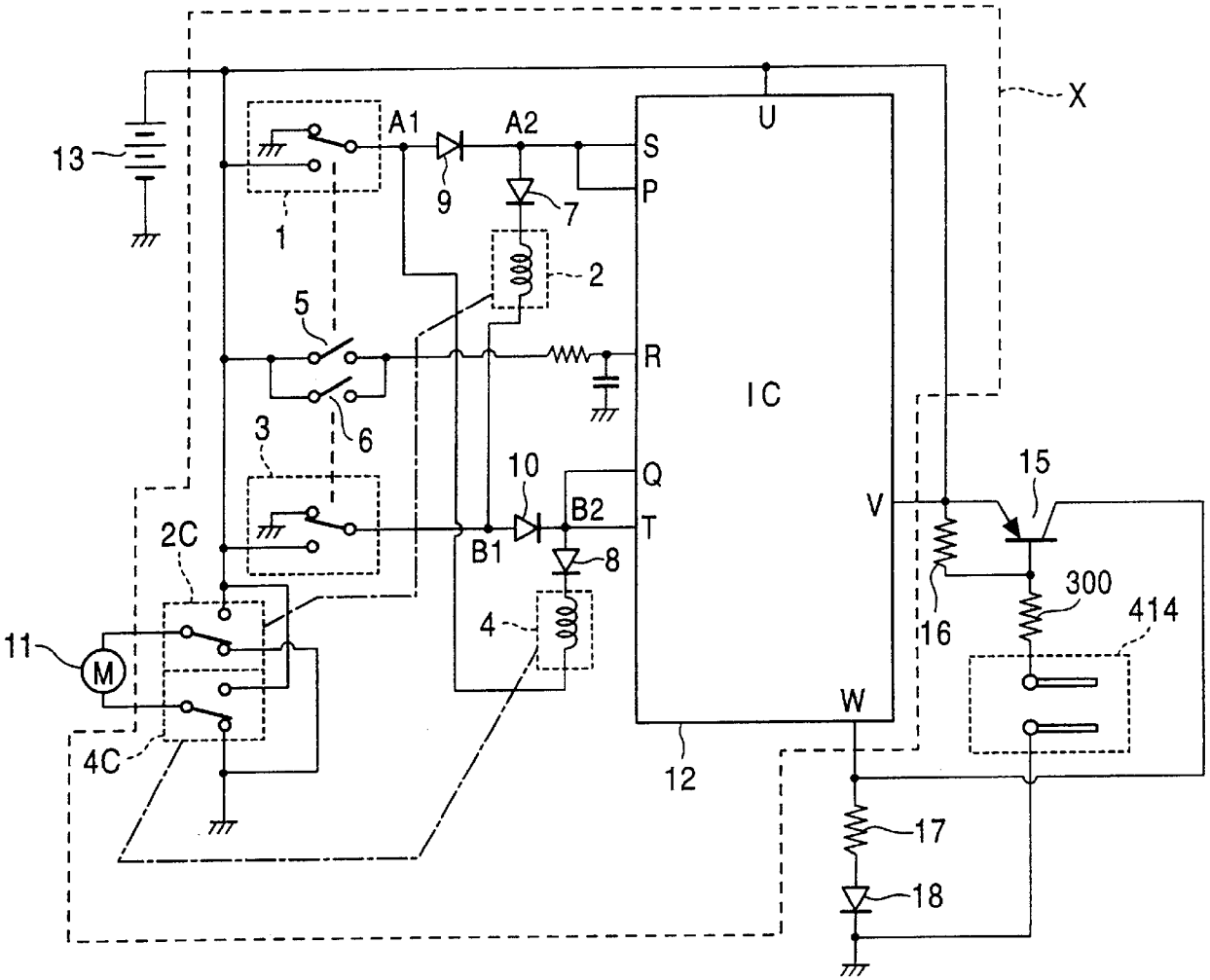
FIG. 11 is a circuit diagram illustrating the principal components of a seventh embodiment of a waterproof power window device according to the present invention.

FIG. 11 is a circuit diagram illustrating the principal components of a seventh embodiment of a waterproof power window device according to the present invention. In FIG. 11, the components which are the same as the components of the fifth embodiment shown in FIG. 7 are denoted with the same reference numerals.

The power window device according to the seventh embodiment is an arrangement wherein a serial resistor 300 has been added to the power window device according to the fifth embodiment. The overall configuration and the basic operation is the same as the fifth embodiment, so description regarding such will be omitted, and description regarding the serial resistor 300 will be made.

In FIG. 11, the transistor 15 has the emitter thereof connected to the terminal V of the controlling IC 12, the collector thereof connected to the terminal W (detecting terminal) of the controlling IC 12, and the base thereof connected to the ground via the serial resistor 300 and the parallel submersion-detecting electro-conductive pins 414. The resistor 16 is connected between the base and emitter of the transistor 15, and the resistor 17 and diode 18 are serially connected between the terminal W of the controlling IC 12 and the ground.

Figure 12:
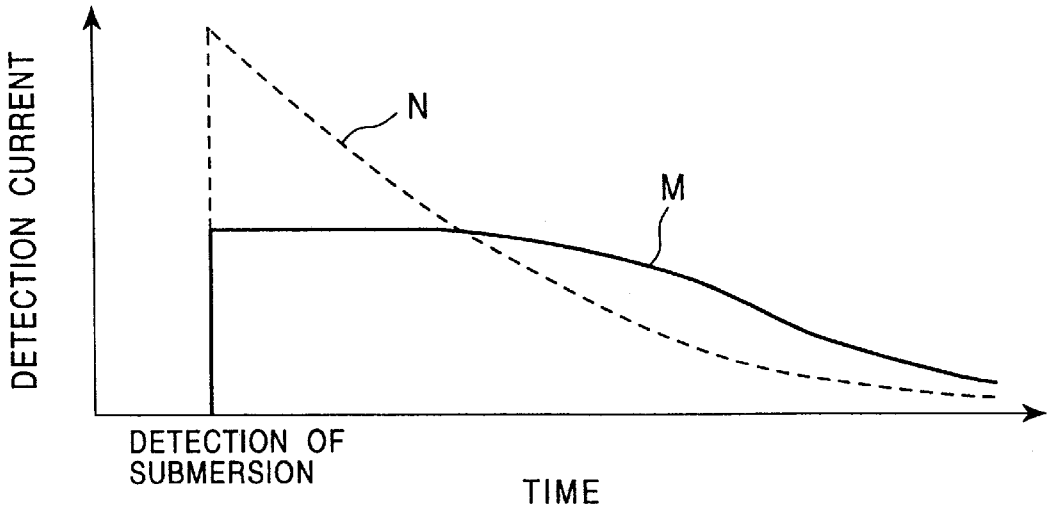
FIG. 12 is a properties diagram illustrating the change in detected electrical current with the waterproof power window device according to the seventh embodiment.
Figure 13:
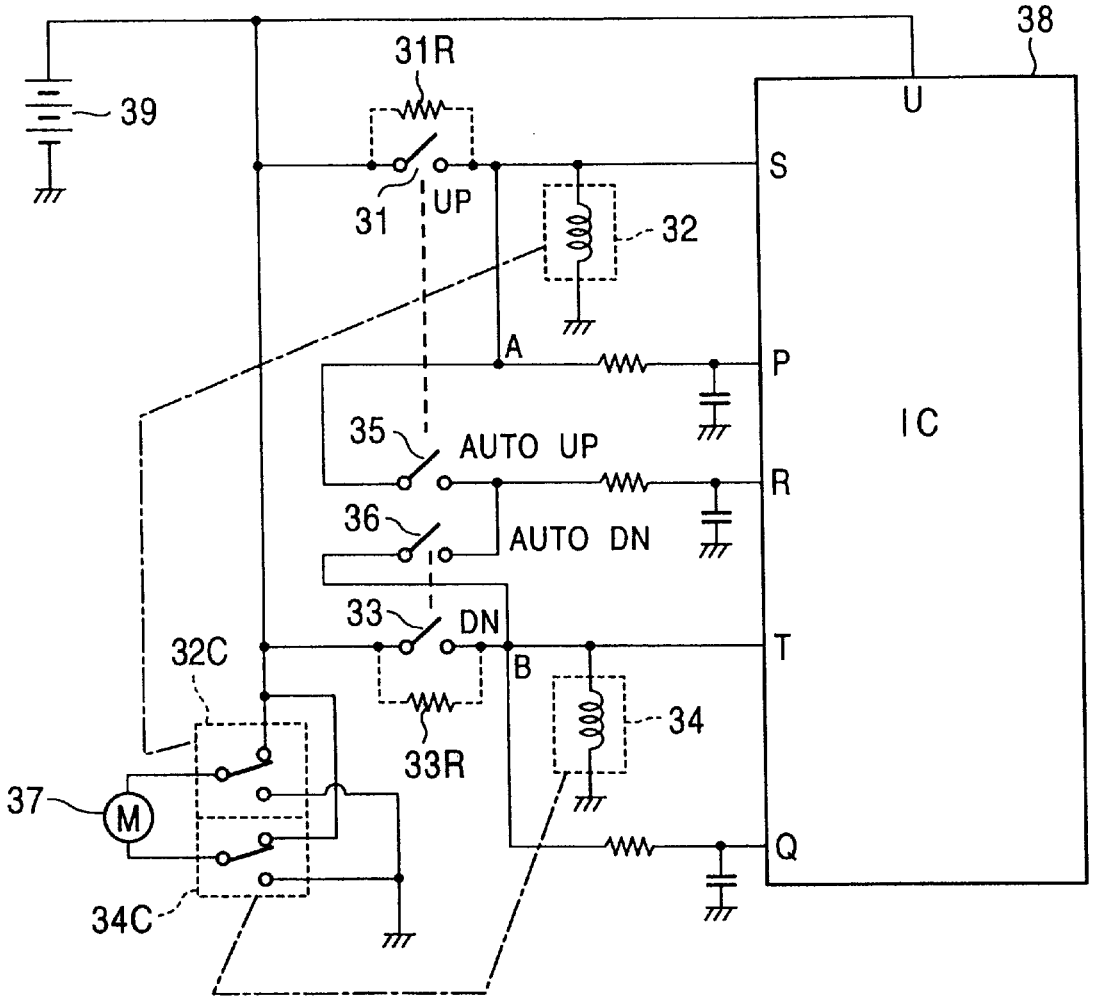
FIG. 13 PRIOR ART
FIG. 13 is a circuit diagram illustrating an example of the configuration of a known waterproof power window device.

Further, FIG. 12 is a properties diagram illustrating an example of detected electrical current flowing through the parallel submersion-detecting electro-conductive pins 414 when detecting water, according to the power window device according to the seventh embodiment.

In FIG. 12, the vertical axis represents the detection current, and the horizontal axis represents time, wherein the curve M shown as a solid line represents the properties curve for the seventh embodiment, and the curve N shown as a dotted line represents the properties curve in the case that the serial resistor 300 is not connected.

The operations of the power window device according to the seventh embodiment with the configuration described above is generally the same as that of the fifth embodiment.

The power window device according to the seventh embodiment has the serial resistor 300 connected, so in the event of the parallel submersion-detecting electro-conductive pins 414 detecting intrusion of water, the detecting current flowing through the base circuit of the transistor 15 does not increase drastically at the point of detection, as shown by the properties curve M in FIG. 12, so the pair of parallel submersion-detecting electro-conductive pins 414 immersed in water are not subjected to sudden electro-corrosion due to a drastically great detecting current flowing through the water. Consequently, a stable detecting current can be maintained over a relatively long period of time.

As a matter of reference, in the event that the serial resistor 300 is not connected, the detecting current flowing through the base circuit of the transistor 15 increases substantially at the point of detection, as shown by the properties curve N in FIG. 12, so the pair of parallel submersion-detecting electro-conductive pins 414 immersed in water are not subjected to sudden electro-corrosion due to the substantially great detecting current flowing through the water. Consequently, the detecting current deteriorates in a relatively short period of time.

The resistance of the serial resistor 300 should be selected to an appropriate value such that the detecting current is reduced to an appropriate level, according to the properties of the transistor 15 and the properties and the like of the pair of parallel submersion-detecting electro-conductive pins 414.

While the above embodiments have been described with reference to an arrangement wherein the semiconductor detecting element 15 in the submersion detecting element is a transistor, the present invention is by no means restricted to such; rather, devices other than a transistor which perform operations similar to those of a transistor may be used as the semiconductor detecting element 15, instead.

What is claimed is:

1. A power window device, comprising:

a window;

a driving source for opening and closing said window;

a submersion detecting element for detecting intrusion of water; and a switching device for controlling the opening and closing of said window, said switching device comprising:

a first switch for manually instructing opening action of the window;

a second switch for manually instructing closing action of the window;

a first driving unit for connecting an electrical source to said driving source so that said driving source is driven in the opening direction based on the operation of said first switch;

a second driving unit for connecting the electrical source to said driving source so that said driving source is driven in the closing direction based on the operation of said second switch;

a control unit to which are connected said first switch, said second switch said first driving unit, said second driving unit, and said submersion detecting element, for controlling said switching device so that opening action of the window can be realized even in the event that the switching device is submerged, in the event that said submersion detecting element detects intrusion of water;

a wiring substrate upon which is mounted at least one of said first switch, said second switch said first driving unit, said second driving unit, and said control unit.

2. The power window device according to claim 1, wherein said first driving unit comprises a first relay which is a window closing relay, said second driving unit comprises a second relay which is a window opening relay, and said driving source is a motor;

and wherein said first relay and said second relay are connected to said control unit such that in the event that said submersion detecting element detects intrusion of water both said first relay and said second relay are energized so as to connect source voltage to both ends of said motor;

and wherein said first relay and said second relay are connected to said first switch such that in the event that said first switch is operated, reverse source voltage is applied to said second relay and source voltage is applied to said first relay.

3. The power window device according to claim 2, wherein said control unit is comprised of a controlling integrated circuit;

and wherein said first switch and said second switch are single-circuit two-contact-point switches of which one end is selectively switched between a power source and a ground;

and wherein the other end of said first switch is connected to one end of said first relay, the other end of said second switch is connected to one end of said second relay, the other end of said first relay is connected to the contact point of said second switch and said second relay and also to a first terminal of said controlling integrated circuit, and the other end of said second relay is connected to the contact point of said first switch and said second relay and also to a second terminal of said controlling integrated circuit.

4. The power window device according to claim 2, further comprising a semiconductor detecting element;

wherein said control unit is comprised of a controlling integrated circuit;

and wherein said controlling integrated circuit has a power source terminal connected to the electrical power source, and also has detecting terminals;

and wherein said semiconductor detecting element is connected between said power source terminal and said detecting terminals, and said submersion detecting element is connected between said semiconductor detecting element the ground, so that said semiconductor detecting element turns on when said submersion detecting element detects submersion, and supplies source voltage to said first relay and said second relay.

5. The power window device according to claim 3, wherein said controlling integrated circuit has a power source terminal connected to the electrical power source, and also has detecting terminals;

and wherein said semiconductor detecting element is connected between said power source terminal and said detecting terminals, and said submersion detecting element is connected between said semiconductor detecting element the ground, so that said semiconductor detecting element turns on when said submersion detecting element detects submersion, and supplies source voltage to said first relay and said second relay from said first terminal and said second terminal.

6. The power window device according to claim 1, wherein said submersion device comprises a pair of conducting pads on said wiring substrate, positioned so as to be exposed with minute spacing therebetween.

7. The power window device according to claim 6, comprising a plurality of said submersion devices.

8. The power window device according to claim 6, wherein said submersion devices are positioned on opposing edges of said wiring substrate.

9. The power window device according to claim 1, wherein said submersion device comprises a pair of conducting poles on said wiring substrate, positioned so as to be erected with minute spacing therebetween.

10. The power window device according to claim 9, comprising a plurality of said submersion devices.

11. The power window device according to claim 10, wherein said submersion devices are positioned on opposing edges of said wiring substrate.

12. The power window device according to claim 9, wherein said submersion device is formed such that the tip portions of said pair of conducting poles is bent outwards from the plane of said substrate, in a manner parallel thereto.

13. The power window device according to claim 4, further comprising an over-current preventing resistor, said over-current preventing resistor being connected between said semiconductor detecting element and said controlling terminal.

14. A control device for a power window device, said control device comprising:

a submersion detecting element for detecting intrusion of water; and a switching device for controlling the opening and closing of said window, said switching device comprising:

a first switch for manually instructing opening action of the window;

a second switch for manually instructing closing action of the window;

a first driving unit for initiating opening action of the window based on the operation of said first switch;

a second driving unit for initiating closing action of the window based on the operation of said second switch;

a control unit forming a controlling integrated circuit to which are connected said first switch, said second switch said first driving unit, said second driving unit, and said submersion detecting element, for controlling said switching device so that opening action of the window can be realized even in the event that the switching device is submerged, in the event that said submersion detecting element detects intrusion of water; and a wiring substrate upon which is mounted at least one of said first switch, said second switch said first driving unit, said second driving unit, and said control unit.

15. The control device according to claim 14, wherein said first driving unit comprises a first relay which is a window closing relay, and said second driving unit comprises a second relay which is a window opening relay;

and wherein said first relay and said second relay are connected to said control unit such that in the event that said submersion detecting element detects intrusion of water both said first relay and said second relay are energized;

and wherein said first relay and said second relay are connected to said first switch such that in the event that said first switch is operated, bias source voltage is applied to said second relay and source voltage is applied to said first relay.

16. The control device according to claim 15, wherein said control unit is comprised of a controlling integrated circuit;

and wherein said first switch and said second switch are single-circuit two-contact-point switches of which one end is selectively switched between a power source and a ground;

and wherein the other end of said first switch is connected to one end of said first relay, the other end of said second switch is connected to one end of said second relay, the other end of said first relay is connected to the contact point of said second switch and said second relay and also to a first terminal of said controlling integrated circuit, and the other end of said second relay is connected to the contact point of said first switch and said second relay and also to a second terminal of said controlling integrated circuit.

17. The control device according to claim 15, further comprising a semiconductor detecting element;

wherein said control unit is comprised of a controlling integrated circuit; and wherein said controlling integrated circuit has a power source terminal connected to an electrical power source, and also has detecting terminals; and wherein said semiconductor detecting element is connected between said power source terminal and said detecting terminals, and said submersion detecting element is connected between said semiconductor detecting element and the ground, so that said semiconductor detecting element turns on when said submersion detecting element detects submersion, and supplies source voltage to said first relay and said second relay.

18. The control device according to claim 15, wherein said controlling integrated circuit has a power source terminal connected to an electrical power source, and also has detecting terminals;

and wherein a semiconductor detecting element is connected between said power source terminal and said detecting terminals, and said submersion detecting element is connected between said semiconductor detecting element the ground, so that said semiconductor detecting element turns on when said submersion detecting element and detects submersion, and supplies source voltage to said first relay and said second relay from a first terminal and a second terminal.

19. The control device according to claim 14, wherein said submersion device comprises a pair of conducting pads on said wiring substrate, positioned so as to be exposed with minute spacing therebetween.

20. The control device according to claim 19, comprising a plurality of said submersion devices.

21. The control device according to claim 20, wherein said submersion devices are positioned on opposing edges of said wiring substrate.

22. The control device according to claim 14, wherein said submersion device comprises a pair of conducting poles on said wiring substrate, positioned so as to be erected with minute spacing therebetween.

23. The control device according to claim 22, comprising a plurality of said submersion devices.

24. The control device according to claim 23, wherein said submersion devices are positioned on opposing edges of said wiring substrate.

25. The control device according to claim 22, wherein said submersion device is formed such that the tip portions of said pair of conducting poles is bent outwards from the plane of said substrate, in a manner parallel thereto.

26. The control device according to claims 17 or 18, further comprising an over-current preventing resistor, said over-current preventing resistor being connected between said semiconductor detecting element and said controlling terminal.

* * * * *

UNITED STATES PATENT AND TRADEMARK OFFICE

CERTIFICATE OF CORRECTION

PATENT NO. : 6,060,794
DATED : May 9, 2000
INVENTOR(S) : Isao Takagi et al.

It is certified that error appears in the above-identified patent and that said Letters Patent is hereby corrected as shown below:

Claim 1,
Line 29, after "second switch" insert -- , -- (comma).

Claim 4,
Line 12, after "element" insert -- and --.

Claim 5,
Line 9, after "element" insert -- and --.

Claim 14,
Line 18, after "switch" insert -- , -- (comma).
Line 26, after "second switch" insert -- , -- (comma).

Claim 18,
Line 9, after "element" insert -- and --.

Signed and Sealed this

Fifth Day of March, 2002

*Attest:*

*Attesting Officer*

JAMES E. ROGAN
*Director of the United States Patent and Trademark Office*